United States Patent [19]

Williams et al.

[11] Patent Number: 5,069,332

[45] Date of Patent: Dec. 3, 1991

[54] JEWELRY BOX

[75] Inventors: Della H. Williams; Robert A. Williams, both of Fort Worth; Jeffrey W. Herron, Arlington; Karen M. Britt, Fort Worth, all of Tex.

[73] Assignee: Williams Instruments, Inc., Fort Worth, Tex.

[21] Appl. No.: 483,365

[22] Filed: Feb. 22, 1990

[51] Int. Cl.[5] ..... A45C 11/04

[52] U.S. Cl. ..... 206/6.1; 206/45.14; 206/495; 206/566; 206/805; 220/337; 220/339

[58] Field of Search ..... 206/6.1, 45.14, 45.15, 206/495, 566, 805; 220/23.4, 337, 339

[56] References Cited

U.S. PATENT DOCUMENTS

| | | | |
|---|---|---|---|
| 4,324,446 | 4/1982 | LeSage | 206/45.14 |
| 4,413,736 | 11/1983 | Nibling | 206/566 |
| 4,420,084 | 12/1983 | Whelan | 206/566 |
| 4,720,012 | 1/1988 | Dufour | 206/495 |
| 4,848,585 | 7/1989 | Snyder | 206/45.14 |
| 4,848,586 | 7/1989 | Tasik | 206/566 |
| 4,919,259 | 4/1990 | Beaulieu | 220/339 |

*Primary Examiner*—David T. Fidei
*Attorney, Agent, or Firm*—Arthur F. Zobal

[57] ABSTRACT

A jewelry box has plural racks, plural covers and retaining bands. Each rack has a board with openings formed therethrough. The openings receive jewelry. A variety of opening sizes are provided. Each rack also has a standoff wall projecting out in front and in back of the board. The racks are pivotally coupled together with hinges in an accordion manner so as to allow the opening and closing of the box by opening and closing the racks. The standoff walls provide gaps between the boards when the box is closed. The covers cover the endmost racks. The covers have projections for receiving the retaining bands, which maintain the box in a closed condition.

16 Claims, 4 Drawing Sheets

JEWELRY BOX

FIELD OF THE INVENTION

The present invention relates to containers for storing jewelry and the like.

BACKGROUND OF THE INVENTION

Conventional jewelry boxes typically have interior trays that are partitioned into small compartments. Jewelry is dropped loosely into these compartments. Frequently, there is much more jewelry than there are compartments so that the jewelry becomes unorganized. Such an unorganized state is particularly unsatisfactory with earrings, which are small and are thus easily lost. Earrings of course come in pairs; failure to find one earring renders the entire pair useless. What is needed is a jewelry box that allows jewelry, and in particular earrings, to be stored in an organized manner.

SUMMARY OF THE INVENTION

It is an object of the present invention to provide a jewelry box that stores earrings and other types of jewelry in an organized manner.

It is another object of the present invention to provide a jewelry box that stores many types of earrings in an easy-to-use manner.

The jewelry box of the present invention includes plural racks, with each rack comprising a board and standoff means coupled to the board. Each board has openings formed therein so that the board is adapted to receive and store jewelry thereon. The racks are pivotally coupled together in an accordion manner. The racks can be folded to a closed position and unfolded to an open position to access the boards. When the racks are in the closed position, the standoff means on each rack engages the adjacent rack to form a gap between the adjacent boards. Covers are pivotally coupled to end racks. The covers cover the boards when the racks are in the closed position. Retaining means are provided for retaining the racks in the closed position.

In one aspect, the racks are pivotally coupled to each other by way of living hinges. In another aspect, the racks are pivotally coupled to each other by way of pin hinges. The pin hinges allow the racks to be interchanged to provide for various combinations of openings and racks in any one jewelry box.

In another aspect, the retaining means comprise elastomeric bands and the covers comprise projection means for receiving portions of the elastomeric bands. The bands are looped around the projections and hold the covers and the racks in the closed position.

In another aspect, the racks comprise alignment means for aligning the racks when they are in the closed position. The alignment means include a tongue and groove arrangement on adjacent racks.

With the jewelry box of the present invention, large amounts of jewelry can be stored in an organized manner in a relatively small amount of space. The jewelry is stored on the rack boards; when several boards are used to make up a jewelry box, a large storage area can be obtained. Furthermore, because the racks fold up in an accordion manner, the box can be folded to a compact size. By providing boards with various sized openings, different types of jewelry can be stored. When the box is used in an upright position, so that the racks are vertical, both the front and back sides of the boards can be accessed, further simplifying jewelry storage and removal.

DESCRIPTION OF PREFERRED EMBODIMENTS

Figures 1, 2, 3, 4:
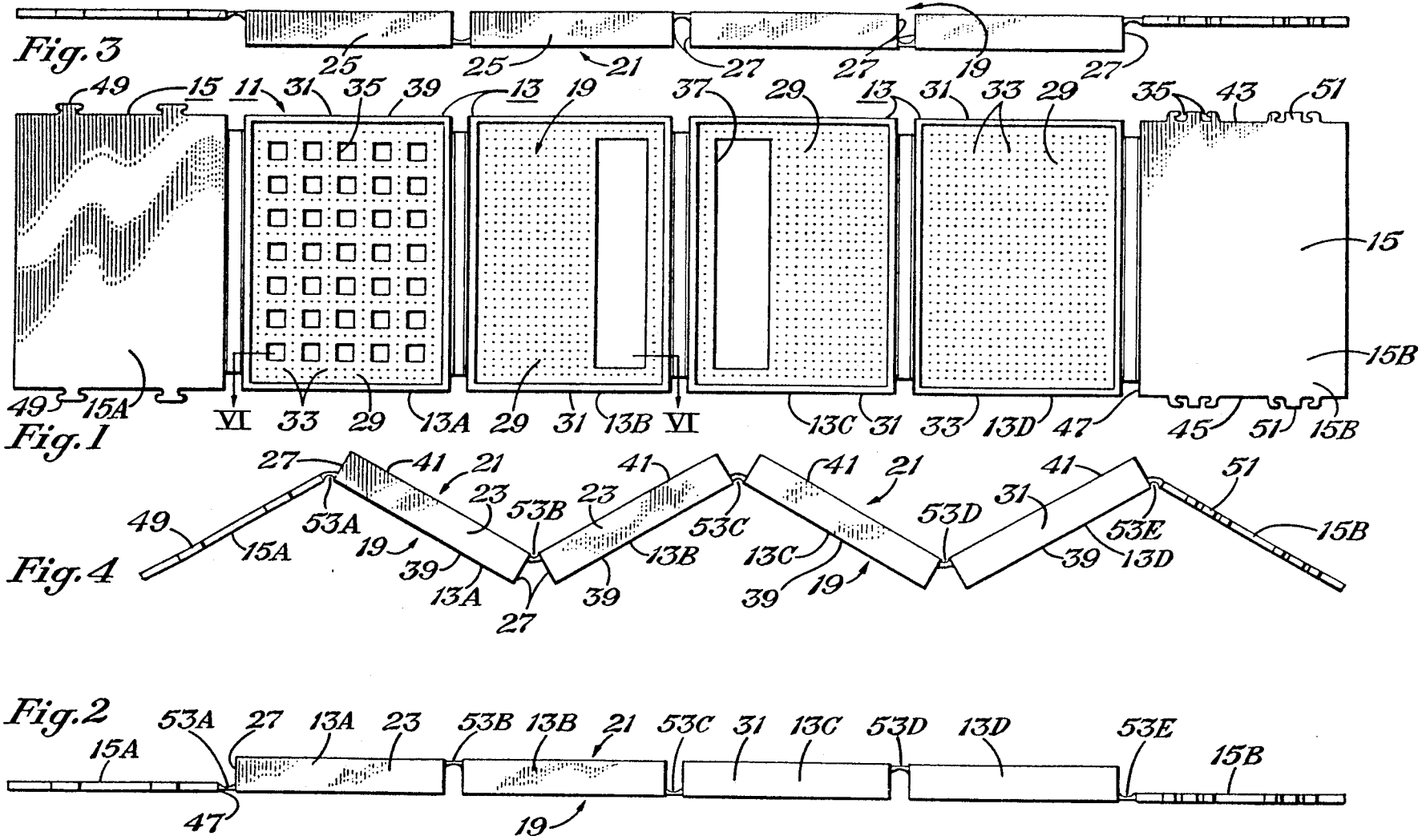
FIG. 1 is a plan view of the jewelry box of the present invention, in accordance with a preferred embodiment, wherein the jewelry box is fully open.
FIG. 2 is a top end view of the box of FIG. 1.
FIG. 3 is a bottom end view of the box of FIG. 1.
FIG. 4 is a top end view of the box, wherein the box is opened to a self supporting upright position.

Referring to FIGS. 1–5, the jewelry box 11 of the present invention has plural racks 13 that are pivotally coupled together in an accordion fashion. The racks, which are flat, have numerous openings thereon. Jewelry, and in particular earrings, are mounted to the racks by insertion into the openings. Various sized openings are provided for receiving various types of earrings. The racks 13 can be folded up to make a compact container, or folded out to allow access to the jewelry. In addition to the racks 13, the box 11 also includes plural covers 15 and retaining bands 17.

Each rack 13 has front and back sides 19, 21 and top, bottom and side edges 23, 25, 27. Each rack 13 includes a board 29 and a standoff wall 31. Each board 29, which has front and back sides corresponding to the front and back sides of the respective rack 13, has numerous openings therethrough for receiving jewelry. In particular, there are small circular openings 33 for receiving the posts of pierced earrings, intermediate sized square openings 35 for receiving clip-on earrings, and large rectangular openings 37 for receiving large types of earrings such as hoop earrings (see FIG. 6). Each board may have one type of opening or it may have plural types of openings. In the preferred embodiment, a first board is provided with plural intermediate sized openings 35. The openings 35 are spaced apart from each other and have small openings 33 therebetween. Second and third boards each have a large opening 37 located near one side and multiple small openings 33. A fourth board has only small openings 33. The openings are arranged in an aesthetic manner, thus in the preferred embodiment the small and intermediate openings 33, 35 are arranged in rows and columns. The boards 29 are generally rectangular.

Figure 7:
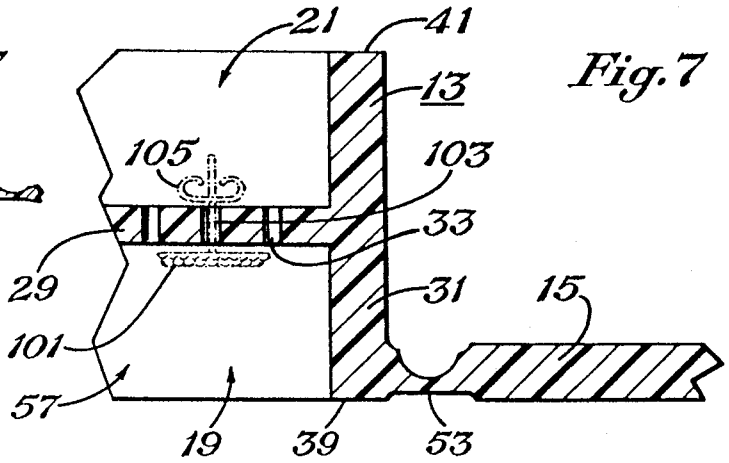
FIG. 7 is a cross-sectional detailed view of the hinge between a cover and a rack, with the cover in the open condition.

Each board 29 is conventionally surrounded by a respective standoff or separation wall 31. The standoff wall 31 is perpendicular to the board 29 and extends out in front of the board and in back of the board, as shown in FIG. 7. The standoff wall has flat front and back edges 39, 41 to abut against a cover or an adjacent standoff wall on an adjacent rack. The standoff walls 31 are integral to the respective boards 29. The standoff walls 31 surround the circumference of the board. Thus, the standoff walls 31 form the top, bottom and side edges 23, 25, 27 of each rack 13.

The covers 15 are flat plates that are rectangular in shape. The covers 15 are about the same size as the racks 13, and have top, bottom and side edges 43, 45, 47. Each cover 15 has plural projections 49, 51 extending out from its top and bottom edges. The projections 49, 51 receive the retaining bands 17.

Figure 8:
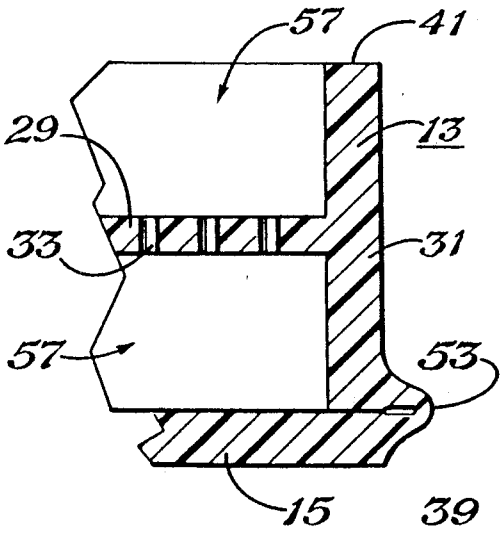
FIG. 8 is a cross-sectional view of the hinge of FIG. 7, with the cover in the closed condition.

The racks 13 and covers 15 are pivotally coupled together along their side edges 27, 47. Referring to FIGS. 7 and 8, a living hinge 53 is used to pivotally couple the racks 13 and covers 15 together. Each living hinge 53 is a plastic strip that extends along the side edges 27, 47 of two racks or of a rack and a cover. The hinge 53 is flexible so as to allow 180 degrees bending. For example, in FIG. 7, the cover 15 is shown in an open position relative to the rack 13. In FIG. 8, the cover 15 has been moved to the closed position, with the hinge 53 flexing accordingly. The living hinge allows many openings and closings without breaking.

The racks 13 and the covers 15 are pivotally coupled together in an accordion manner. In the embodiment shown in FIGS. 1–5, there are first, second, third and fourth racks 13A, 13B, 13C, 13D, with the first and fourth racks 13A, 13D being end racks. There are also first and second covers 15A, 15B. Referring to FIGS. 2 and 4, the first cover 15A is coupled to the first rack 13A along the respective side edges 47, 27. The hinge 53A is located near the front side 19 of the first rack 13 so that the first cover 15A can swing and cover the front side 19 of the first rack 13A. The first rack 13A is coupled to the second rack 13B along the respective side edges 27. The hinge 53B is located near the back sides 21 of the first and second racks 13A, 13B so that the first and second racks can swing and cover the back sides of each other. The hinge 53C couples the second and third racks 13B, 13C together and is located near the front sides 19 of the second and third racks so that the second and third racks can swing and cover the front sides of each other. The hinge 53D couples the third and fourth racks 13C, 13D together and is located near the back sides 21 of the third and fourth racks so that the third and fourth racks can swing and cover the backs of each other. The hinge 53E couples the fourth rack 13D and the second cover 15B and is located near the front side 19 of the fourth rack 13D so that the second cover 15B can swing and cover the front side of the fourth rack.

When the racks 17 and the covers 15 are fully opened, they appear as shown in FIGS. 1–3. The box 11 can be stood on the bottom edges of the covers and the racks, wherein the racks 13 are oriented in a vertical position for easy access to the front and back sides 19, 21 of the racks. More specifically, the box 11 is stood on the projections 49, 51 of the covers 15. When the box is so used, the hinges 53 are bent slightly for stability, as shown in FIG. 4. In this configuration, wherein the box is partially open, each cover and rack is angled with respect to the adjacent cover or rack to provide stability and maintain the racks in a vertical position.

Figure 6:
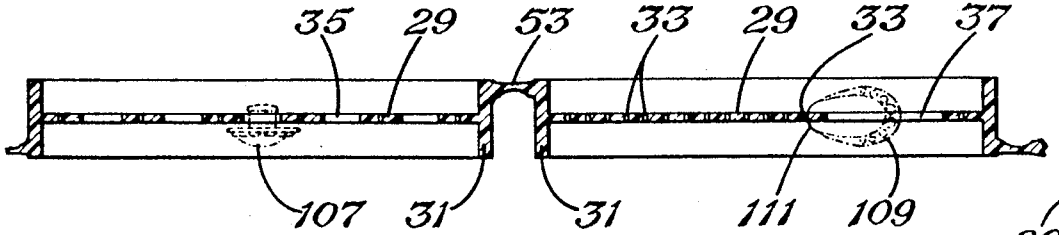
FIG. 6 is a cross-sectional view taken through lines VI—VI of FIG. 1.

To store jewelry in the box 11, the box is opened. Referring to FIG. 7, pierced earrings 101 are stored by inserting the respective post 103 into a small opening 33 from the front side 19 and securing the post in place on the back side with the earring clamp or back 105. Both of the earrings making up a pair can be stored adjacent to each other in different openings 33. Referring to FIG. 6, clip-on earrings 107 are inserted into the intermediate size openings 35 and clipped to the edge of the respective openings. Hoop earrings 109 are inserted into the large openings 37, wherein the respective earring mounting pin 111 is inserted into a small opening 33 adjacent to the large opening. The earring mounting pin 111 is then secured in conventional fashion. Of course, the front and back sides 19, 21 of the racks are arbitrarily chosen. Jewelry can be put onto both sides of the racks. Also, the box can be opened and laid down on a table, or it may be stood upright with the racks in a vertical position.

Figure 5:
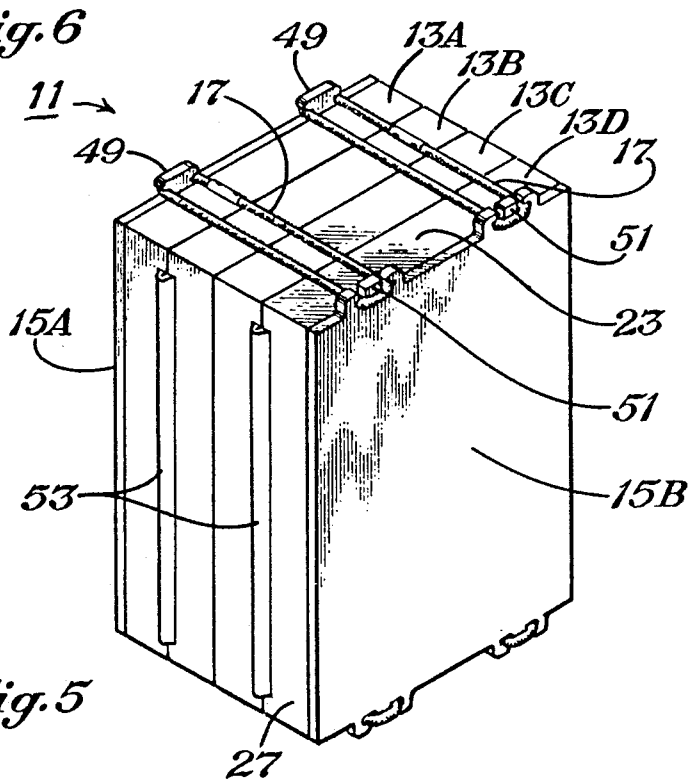
FIG. 5 is an isometric view of the jewelry box, shown in a closed condition.

To close the box 11 from the open position, whether fully open or partially open, the covers and racks are folded as shown in FIG. 5. Specifically, the first cover 15A and first rack 13A are folded so that the first cover 15A contacts the front edge 39 of the first rack standoff wall 31 and the first cover 15A covers the front side 19 of the first rack 13A (see also FIG. 4); the first and second racks 13A, 13B are folded so that their standoff wall back edges 41 contact each other and cover the back sides 21 of the first and second racks; the second and third racks 13B, 13C are folded so that their standoff wall front edges 39 contact each other and cover the front sides 19 of the second and third racks. The third and fourth racks 13C, 13D are folded so that their standoff wall back edges 41 contact each other and cover the back sides 21 of the third and fourth racks; the fourth rack 13D and the second cover 15B are folded so that the second cover contacts the front edge 39 of the fourth rack standoff wall 31 and the second cover covers the front side of the fourth rack.

The box 11 is maintained in its closed state by plural retaining bands 17. The retaining bands are elastomeric bands such as hair bands, rubber bands, or even O-rings. Each band is looped around a projection 49 on the first cover 15A and then around a projection 51 on the second cover 15B, as shown in FIG. 5. There are bands on the top and bottom portions of the box.

The projections 51 of the second cover 15B are designed to retain the bands 17 on the second cover, when the box is opened, to prevent their misplacement. Each projection has two grooves 55 cut therein. The grooves 55 are sized to matingly fit the transverse cross-section of the bands 17, to firmly hold the bands in place once inserted into the grooves.

When the box 11 is closed, gaps 57 are formed between adjacent boards 29 and covers 15 (see FIG. 8). These gaps 57 are formed by the standoff walls 31, which contact each other and which contact the covers 15. The standoff walls 31 cause the boards 19 to stand off from each other when the box is closed. The standoff walls 31 also cause the covers 15 to stand off from the end boards. Jewelry that is mounted to the boards extend into the gaps, allowing the box to be closed without damaging the jewelry.

In FIGS. 9–15, there is shown the jewelry box 61 of the present invention, in accordance with another preferred embodiment. The jewelry box has plural racks 63 and plural covers 65. Retaining bands 17 are used to maintain the box 61 in a closed condition.

Figure 9:
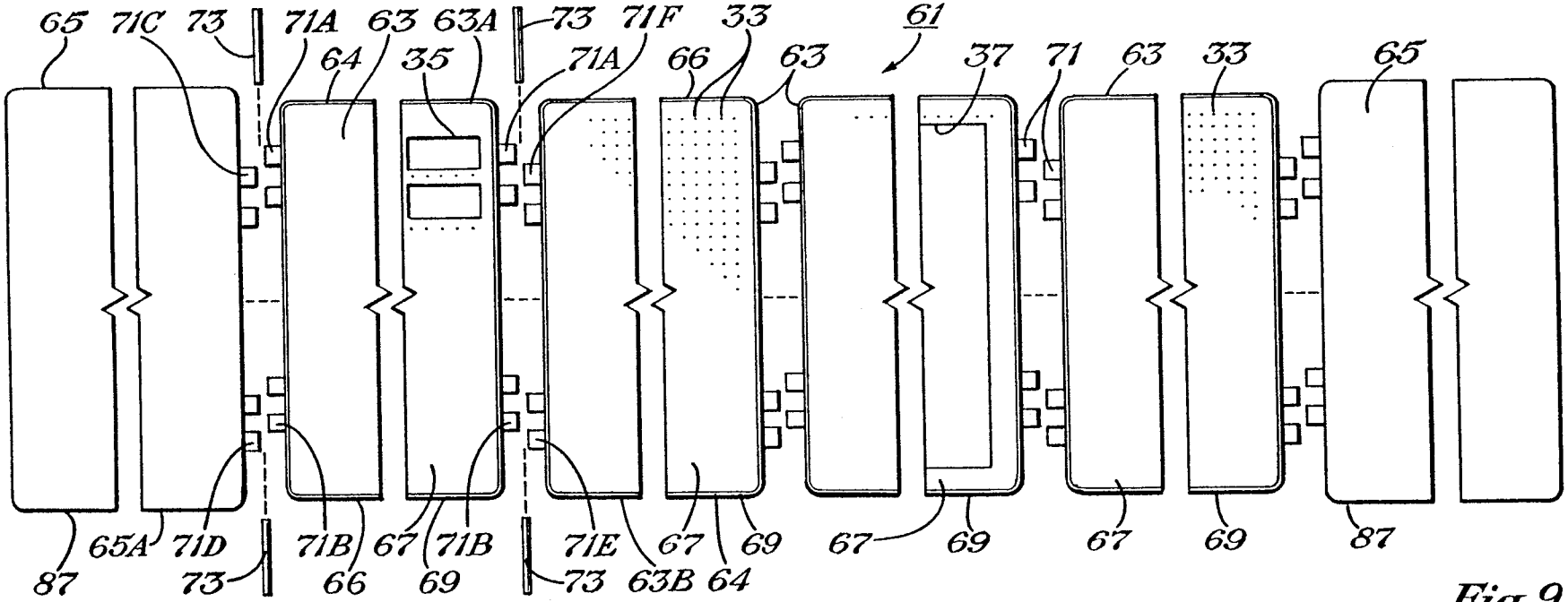
FIG. 9 is an exploded schematic plan view of the jewelry box of the present invention, in accordance with another embodiment.
Figure 10:
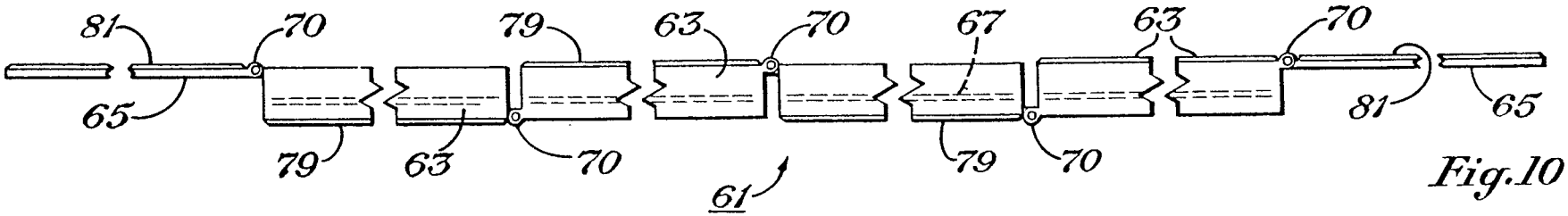
FIG. 10 is a top end view of the box of FIG. 9, shown with the covers and racks coupled together.
Figure 14:
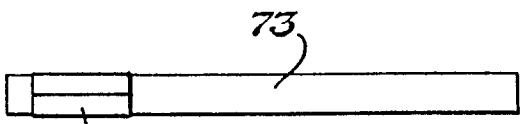
FIG. 14 is a plan view of a pin used in the hinges of the box of FIG. 9.
Figure 15:
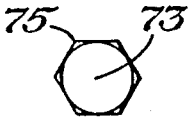
FIG. 15 is an end view of the pin of FIG. 14.
Figure 12:
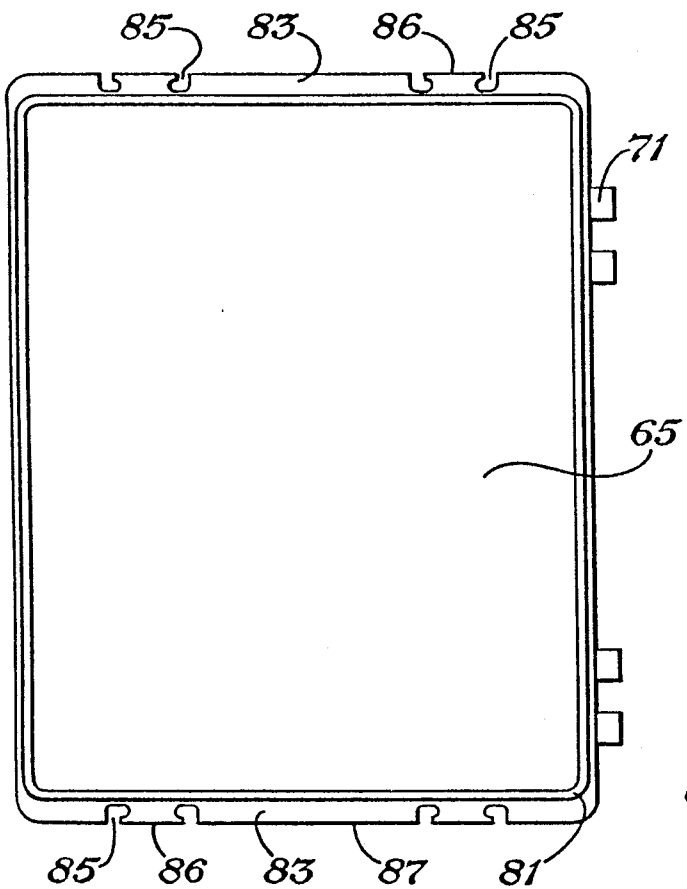
FIG. 12 is a plan view of a cover.

The racks 63 are similar to the racks 13 of the box 11 of FIGS. 1-8. Each rack 63 has a board 67 and a standoff wall 69. The boards 67, which are shown schematically in FIG. 9, have various sized openings, as described above with respect to the boards 29 of FIG. 1. The racks are pivotally coupled together with pin hinges 70. As shown in FIG. 9, each rack has two sets of hinge knuckles 71 on each side. These hinge knuckles 71 engage corresponding hinge knuckles on adjacent racks and covers. Thus, a first rack 63A has on one side an upper set and a lower set of hinge knuckles 71A, 71B that respectively engage upper and lower sets of hinge knuckles 71C, 71D on a first cover 65A. Pins 73 are inserted into the upper and lower sets of knuckles to secure the hinges. Likewise, on the other side of the first rack 63A is an upper set and a lower set of hinge knuckles that respectively engage upper and lower sets of hinge knuckles on a second rack 63B. Pins 73 are inserted into these knuckles as well. The remaining racks and cover are pivotally coupled together in this manner. In FIG. 9, the remaining pins are omitted for clarity. Referring to FIGS. 14 and 15, each pin 73 is cylindrical, except for a portion 75 having a hexagonal transverse cross section. The hexagonal portion produces an interference fit between the pin and one of the knuckles, thereby retaining the pin inside of the knuckles.

The hinges 70 are in the same relative positions to the front and back sides of the racks as described above in FIGS. 1-5. Thus, the racks and covers are pivotally coupled together in an accordion manner.

For greater flexibility in storing jewelry, the racks 63 are made so that they can be interchanged. This allows any number of racks to be used in a single jewelry box, and also allows racks having the desired size openings to be selected for use in the box. Interchangeability in the box is achieved by having interchangeable hinge knuckles. For example, the first rack 63A has two upper sets of knuckles 71A positioned relatively close to the nearest edge 64 of the rack. The first rack 63A also has two lower sets of knuckles 71B that are positioned relative to their nearest edge 66 at a distance which is further than the distance between the upper sets of knuckles 71A and the edge 64. The second rack 63B, with regard to the hinge knuckles, is essentially the same as the first rack 63A, except the second rack is turned upside down, wherein the lower sets of knuckles 71E are positioned close to the bottom edge 64 and the upper set of knuckles 71F are positioned further from the top edge 66. By maintaining irregular knuckle positions between the upper and lower sets of a rack and by reorienting a rack when required, a rack can be pivotally coupled to any other rack.

Figure 11:
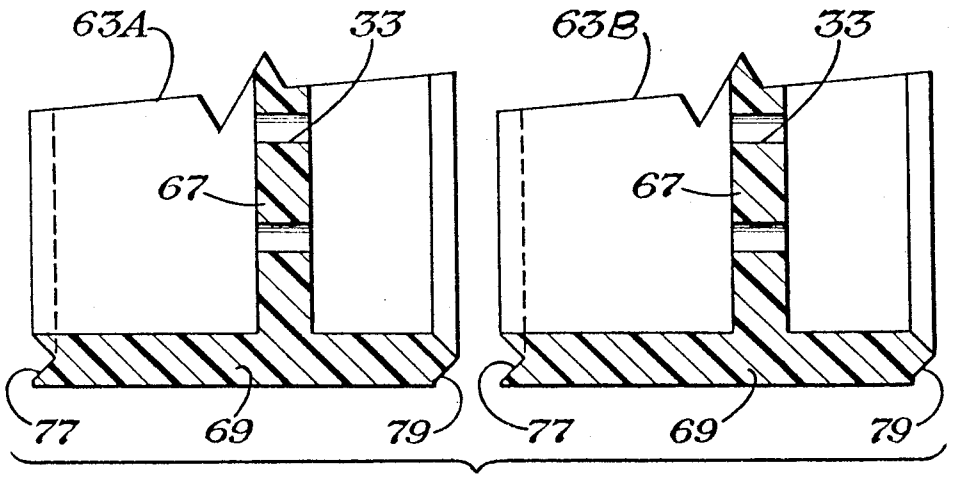
FIG. 11 is a cross-sectional detail view of the tongue and groove alignment arrangement on two racks.
Figure 13:
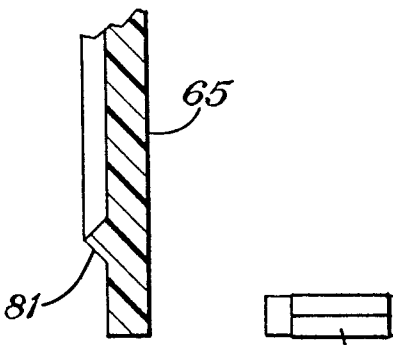
FIG. 13 is a cross-sectional detail view of a cover, showing the alignment tongue thereon.

The racks and covers have alignment means for alignment with respect to each other when the box is closed. Referring to FIG. 11, where the hinges are omitted for clarity, the racks have tongue and groove arrangements in the front and back edges of their standoff walls 69. Thus, for example, the first rack 63A has a groove 77 in the front edge of its standoff wall 69. The groove is circumferential in that it extends around the circumference of the board 67. The first rack also has a protruding tongue 79 in the back edge of its standoff wall 69. The tongue is also circumferential around the board. The second rack has a groove 77 in its standoff wall back edge, which groove matingly receives the tongue 79 of the first rack. The second rack has a tongue 79 in its standoff wall front edge for engaging a groove in the third rack, and so on. The tongues and grooves are, in transverse cross-section, "V" shaped to provide for self centering of the racks. Thus, when the racks are closed together, the tongues and grooves engage, aligning the racks and preventing any lateral movement of the racks. Each cover has a circumferential tongue 81, shown in FIGS. 12 and 13. The tongue is received by grooves in the first and fourth racks (which are the end racks). In the preferred embodiment, the fourth rack has grooves in its front and back edges, to accommodate the tongues of the third rack and the second cover.

The covers 65 are slightly longer from top to bottom edge than the racks. Thus, each cover has strips 83 that project beyond the tongues. Grooves or notches 85 are formed in these strips forming projections 86 for receiving the retaining bands 17. One set of notches in one of the covers are smaller than the notches in the other cover, so as to retain the band 17 on the respective cover. When the box is stood on end, so that the racks are vertical, the box bears on the bottom edges 87 of the covers.

In the preferred embodiment, the box is made out of a transparent plastic material. The living hinge embodiment 11 is injection molded as a single unit. The pin hinge embodiment 61 is made out of polycarbonate (LEXAN). The use of a transparent material allows a user to see inside of the box without opening it. Alternatively, the box may be made out of opaque material.

The jewelry box 11 of FIGS. 1-5 can be made to incorporate the tongue and groove alignment means described in conjunction with the box 61. Also, the jewelry box 11 can incorporate the longer covers 65 of the box 61, with the covers being notched to receive the retaining bands 17.

The foregoing disclosure and the showings made in the drawings are merely illustrative of the principles of this invention and are not to be interpreted in a limiting sense.

We claim:

1. A jewelry box, comprising:

a) plural racks, with each rack comprising a board and standoff means coupled to said board;

b) said board having openings formed therein so that said board is adapted to receive and store jewelry thereon;

c) said racks being pivotally coupled together in an accordion manner defining at least two end racks, wherein said racks can be folded to a closed position and unfolded to an open position to access said boards, wherein when said racks are in said closed position, said standoff means on each rack engages the adjacent rack to form a gap between the adjacent boards;

d) said two end racks being pivotally coupled to two covers respectively for covering said boards of said two end racks when said racks are in said closed position;

e) said racks being pivotally coupled together and said covers being pivotally coupled to said two end racks in a manner such that said racks and said two covers may be unfolded to extend generally in the same plane;

f) retaining means for retaining said racks in said closed portion.

2. The jewelry box of claim 1 wherein said racks are pivotally coupled to each other by way of living hinges.

3. The jewelry box of claim 1 wherein said racks are pivotally coupled to each other by way of pin hinges.

4. The jewelry box of claim 3 wherein said retaining means comprises elastomeric bands and said covers comprise means for receiving portions of said retaining means bands, wherein said retaining means bands couple said covers in a closed position.

5. The jewelry box of claim 4 wherein said racks further comprise alignment means for aligning said racks when said racks are in said closed position.

6. The jewelry box of claim 5 wherein said alignment means comprises a tongue and groove arrangement on adjacent racks, with one rack of an adjacent set of racks having a tongue and the other rack of the adjacent set having a groove for receiving said tongue.

7. The jewelry box of claim 6 wherein said boards have various sizes of openings.

8. The jewelry box of claim 1 wherein said retaining means comprises elastomeric bands and said covers comprises means for receiving portions of said retaining means bands, wherein said retaining means bands couple said covers in a closed position.

9. The jewelry box of claim 1 wherein said alignment means comprises a tongue and groove arrangement on adjacent racks, with one rack of an adjacent set of racks having a tongue and the other rack of the adjacent set having a groove for receiving said tongue.

10. The jewelry box of claim 1 wherein there are at least three racks, with adjacent racks being pivotally coupled together such that said racks are pivotally coupled together in series.

11. A jewelry box, comprising:

a) at least three racks, with each rack having top, bottom and side edges, and with each rack comprising a board and a spacer wall, said spacer wall being coupled to said board and extending around a circumference of said board, said spacer wall extending outwardly from said board;

b) said board having opening formed therein so that said board is adapted to receive and store jewelry thereon;

c) each rack having first and second opposite facing sides;

d) hinge means pivotally coupling said racks together in series such that there are two end racks and at least one intermediate rack with said one intermediate rack having its two side edges pivotally coupled to the side edges of adjacent racks and said two end racks each having one side edge pivotally coupled to the side edge of an adjacent rack such that said racks can be manipulated between closed and open positions, wherein when said racks are in said closed position said boards are generally parallel to each other and each board is spaced apart from adjacent boards by said respective spacer means;

e) said hinge means allowing said racks to be folded together to said closed position such that at least two front sides of the board means of adjacent racks face together and at least two back sides of the board means of adjacent racks face together;

f) covers that are pivotally coupled to said end racks so as to cover said boards of said end racks when said racks are in the closed position;

g) said racks having alignment means for aligning said racks with respect to each other when said racks are in the closed position, said alignment means comprising a tongue and groove arrangement for each adjacent set of racks, with one rack of an adjacent set of racks having a tongue and the other rack of the adjacent set of racks having a groove for receiving said tongue, wherein at least one of said tongue or said groove is located on a spacer wall of one of the adjacent set of racks;

h) retaining bands for retaining said box in a closed position, said covers having projection means for receiving portions of said retaining bands.

12. A jewelry box, comprising:

a plurality of racks, each rack comprising board means for supporting jewelry and two edge walls located at opposite edges of said board means, each of said racks having first and second opposite facing sides, two cover means, at least two of said racks being end racks, hinge means coupled to each of said edge walls of each of said racks for pivotally coupling said racks together in series and said two covers to said two end racks respectively whereby said racks and said two covers may be stretched out to an open position such that said racks and said two covers extend generally in the same plane, said hinge means allowing said racks to be folded in a closed position where they are generally parallel to each other and said cover means to be folded next to said end racks, respectively.

13. The jewelry box of claim 12, wherein:

said first and second sides of said racks are defined as front and back sides respectively, each of said racks has one of its said hinge means coupled to one of its edge walls only next to one of its said front and back sides and the other of its said hinge means coupled to the other of its edge walls only next to the other of its said front and back sides.

14. The jewelry box of claim 12, wherein:

each of said board means of each of said racks is spaced inward from its said edge walls to provide space on each side of said board means of each of said racks for receiving jewelry.

15. The jewelry box of claim 13, wherein:

each of said board means of each of said racks is spaced inward from its said edge walls to provide space on each side of said board means of each of said racks for receiving jewelry.

16. The jewelry box of claim 15, wherein:

said plurally of racks comprise three of said racks, said hinge means allowing said racks to be folded together such that at least two front sides of adjacent racks face each other and at least two back sides of adjacent racks face each other.

* * * * *